US008827334B2

(12) United States Patent
Endara et al.

(10) Patent No.: US 8,827,334 B2
(45) Date of Patent: Sep. 9, 2014

(54) ANIMAL WASTE COLLECTION DEVICE

(71) Applicants: Jorge I. Endara, Valley Village, CA (US); Lori J. Endara, Valley Village, CA (US)

(72) Inventors: Jorge I. Endara, Valley Village, CA (US); Lori J. Endara, Valley Village, CA (US)

( * ) Notice: Subject to any disclaimer, the term of this patent is extended or adjusted under 35 U.S.C. 154(b) by 0 days.

(21) Appl. No.: 14/022,632

(22) Filed: Sep. 10, 2013

(65) Prior Publication Data

US 2014/0077511 A1 Mar. 20, 2014

Related U.S. Application Data

(60) Provisional application No. 61/702,503, filed on Sep. 18, 2012.

(51) Int. Cl.
*E01H 1/12* (2006.01)
*A01K 29/00* (2006.01)

(52) U.S. Cl.
CPC ..... *E01H 1/1206* (2013.01); *E01H 2001/1293* (2013.01)
USPC ..... 294/1.4; 294/176; 15/257.2; 56/400.04

(58) Field of Classification Search
USPC ..... 294/1.3–1.5, 176, 50.8, 50.9, 57, 59; 15/257.1, 257.2; 56/400.04, 400.12, 56/400.16
See application file for complete search history.

(56) References Cited

U.S. PATENT DOCUMENTS

| | | | | | |
|---|---|---|---|---|---|
| 4,222,597 | A * | 9/1980 | Willis | 294/1.4 |
| D267,593 | S * | 1/1983 | Crawford et al. | D34/1 |
| 4,705,310 | A * | 11/1987 | Scripter | 294/1.4 |
| 4,962,956 | A * | 10/1990 | Scripter | 294/1.4 |
| 6,052,860 | A * | 4/2000 | Coxsey | 294/1.4 |
| 6,478,351 | B1 * | 11/2002 | Nelson | 294/1.4 |
| 6,520,554 | B2 * | 2/2003 | Ditzik | 294/214 |
| 6,941,896 | B1 * | 9/2005 | Morin | 294/1.3 |

* cited by examiner

*Primary Examiner* — Paul T Chin
(74) *Attorney, Agent, or Firm* — Loza & Loza, LLP; Heidi L. Eisenhut

(57) ABSTRACT

A device for collecting waste that allows a user to stand upright and place the waste in a disposable bag such that the non-disposable parts of the device do not come into contact with the waste is provided. The device includes a containment mechanism for containing collected waste and a scooping mechanism placing the waste in containment mechanism. The containment mechanism includes a receptacle for receiving a bag for the waste; an elongated member attached to the receptacle at one end and a handle member at a second end. The scooping mechanism includes an elongated handle having a first handle end and a second handle end; a grip portion integrally connected to the first handle end; and a lower plate portion integrally connected to the second handle end, the lower plate portion including a plurality of tines.

19 Claims, 4 Drawing Sheets

ANIMAL WASTE COLLECTION DEVICE

CLAIM OF PRIORITY

The present application for patent claims priority to U.S. Provisional Application No. 61/702,503 entitled "Animal Waste Collection Device", filed Sep. 12, 2012, which is hereby expressly incorporated by reference.

FIELD

Various features relate to devices for collecting litter and waste and more particularly for collecting animal waste.

BACKGROUND

There are over 78 million owned dogs in the United States. If dogs aren't taken for daily walks they tend to get bored which often leads to behavioral problems such as excessive excitement, barking and digging holes. Furthermore, the lack of activity can also lead to obesity. However, when walking dogs, it is very common for the dog to defecate, especially dogs that live in apartments who must be taken for walks to relieve themselves.

It is very important for the dog walker to clean up after the dog out of courtesy and the fact that it is the law as many cities have laws requiring pet owners to clean up after their pets. These laws exist as this waste is repugnant, unsightly, smelly and a breeding medium for germs and disease. Removing the waste and disposing of it properly is therefore a public health and safety concern.

Picking up the waste is not the most pleasant of tasks regardless of whether the waste is from walking a dog out in public or if the waste is located in the backyard of the dog owner. Conventional ways to clean up the waste is by the dog walker bending down and scooping up the waste into a plastic bag. However, this is very unpleasant as the individual can feel the heat from the waste and bending down increases the proximity to the waste and as a result the unpleasant smell is stronger. Additionally, individuals that have bad backs, arthritis or other health issues do not have the ability to bend down to clean up after the waste.

There are a number of devices currently on the market designed to make the collection process more sanitary, including shovels and scoops, by preventing any contact directly with the waste. However, in the process of cleaning up the waste, the devices come in contact with the waste requiring the device to be cleaned.

In view of the foregoing, what is needed is a device for collecting waste that allows a user to stand upright and places the waste in a disposable bag such that the non-disposable parts of the device do not come into contact with the waste.

SUMMARY

The following presents a simplified summary of one or more implementations in order to provide a basic understanding of some implementations. This summary is not an extensive overview of all contemplated implementations, and is intended to neither identify key or critical elements of all implementations nor delineate the scope of any or all implementations. Its sole purpose is to present some concepts of one or more implementations in a simplified form as a prelude to the more detailed description that is presented later.

According to one feature a waste collection device is provided. The waste collection device includes a containment mechanism for containing collected waste and a scooping mechanism for placing the waste in the containment mechanism. The containment mechanism includes a receptacle for receiving a bag for collecting the waste; an elongated member having a first end and a second end, the first end of the elongated member integrally connected to and extending perpendicularly from the receptacle; a handle member secured to the second end of the elongated member; and a plurality of retaining members extending outwardly from the handle member. The plurality of retaining members extending perpendicularly outwardly from the side portion and are adapted to receive the elongated handle of the scooping mechanism. According to one aspect, each retaining member in the plurality of retaining members has a generally convex configuration. Additionally, each retaining member has a first end and a second; and wherein the first end is secured to an outer surface of the side portion of the handle member. The first end of each retaining member in the plurality of retaining members may be located in the same vertical plane on the outer surface of the side portion of the handle member.

The scooping mechanism includes an elongated handle having a first handle end and a second handle end; a grip portion integrally connected to the first handle end; and a lower plate portion integrally connected to the second handle end, the lower plate portion including a plurality of tines.

According to one aspect, the handle member includes a lower portion; an upper portion; and a side portion integrally connected to the lower portion and the upper portion forming a generally U-shaped configuration. The lower portion and the upper portion are substantially perpendicular to the elongated member. Additionally, the lower portion has a first length and the upper portion has a second length; and wherein the second length is greater than the first length.

According to another aspect, a pair of opposing channels may be formed in the lower portion and the side portion of the handle member.

According to another aspect, the receptacle includes a top portion; a bottom portion, the bottom portion integrally connected to the top portion by a first side and a second side; and a back portion integrally connected to the top portion, the bottom portion, the first side and the second side. The bottom portion and the top portion may have a generally square or rectangular configuration, where the bottom portion has a first surface area and the top portion has a second surface area where the first surface area is larger than the second surface area. According to one aspect, the first and second sides have a convex shape.

According to another aspect, waste collection device further includes a bag attachment member extending upwardly from the top portion of the receptacle. The bag attachment member may have a circular opening for receiving part of a removable bag placed within the receptacle securing the removable bag to the receptacle.

According to another feature a waste collection device is provided. The collection device includes a containment mechanism having a receptacle for receiving a bag for collecting waste; an elongated member having a first end and a second end, the first end of the elongated member integrally connected to and extending perpendicularly from the receptacle and a handle member secured to the second end of the elongated member. The handle member includes a lower portion an upper portion; and a side portion integrally connected to the lower portion and the upper portion forming a generally U-shaped configuration. The handle member also includes a pair of opposing channels are formed in the lower portion and the side portion and a plurality of retaining members extending outwardly from the handle member. The collection device further includes a scooping mechanism having an elongated handle having a first handle end and a second handle end; a grip portion integrally connected to the first handle end; and a lower plate portion integrally connected to the second handle end, the lower plate portion including a plurality of tines.

DETAILED DESCRIPTION

The following detailed description is of the best currently contemplated modes of carrying out the invention. The description is not to be taken in a limiting sense, but is made merely for the purpose of illustrating the general principles of the invention. Furthermore, in the following description, specific details are given to provide a thorough understanding of the embodiments. However, it will be understood by one of ordinary skill in the art that the embodiments may be practiced without these specific details.

While the present invention is described primarily with respect to the collection of animal waste, the present invention may be applied and adapted to collecting other types of waste, trash and yard debris such as leaves, branches and fruit that have fallen from trees or other bushes.

Figure 1:
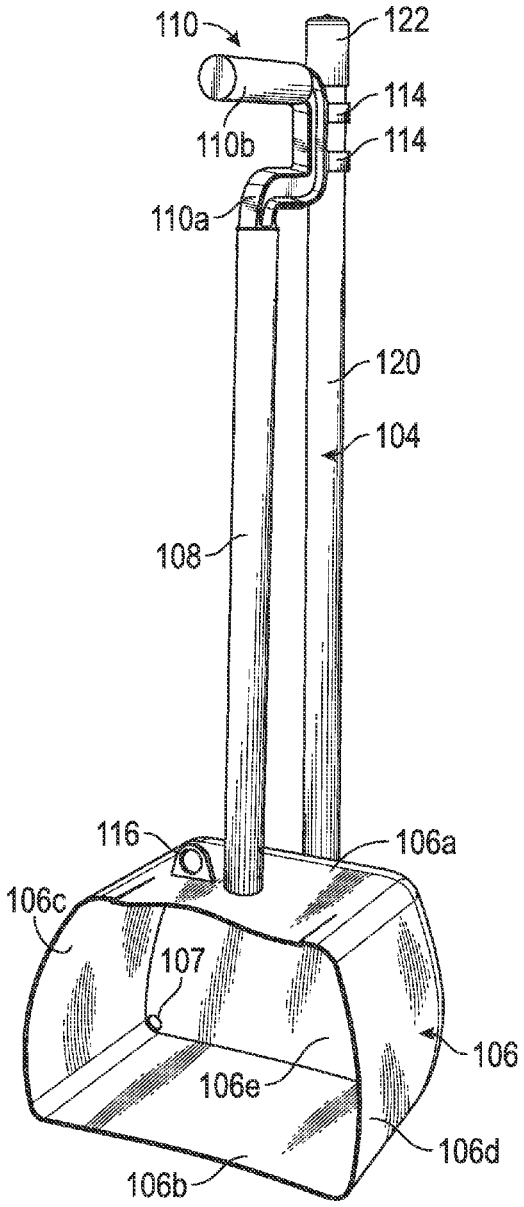
FIG. 1 illustrates a front perspective view of a waste collection device according to one embodiment of the present invention.
Figure 2:
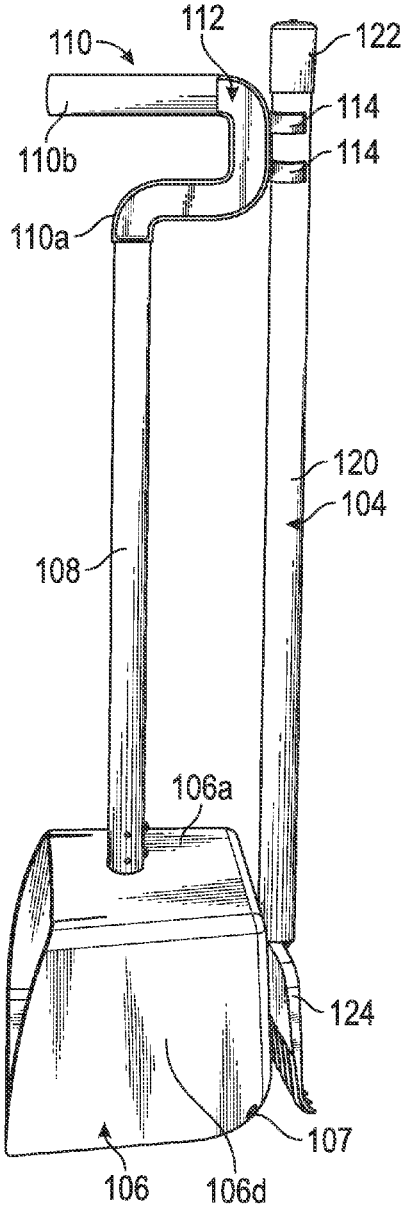
FIG. 2 illustrates a side elevation view of the waste collection device of FIG. 1.
Figure 3:
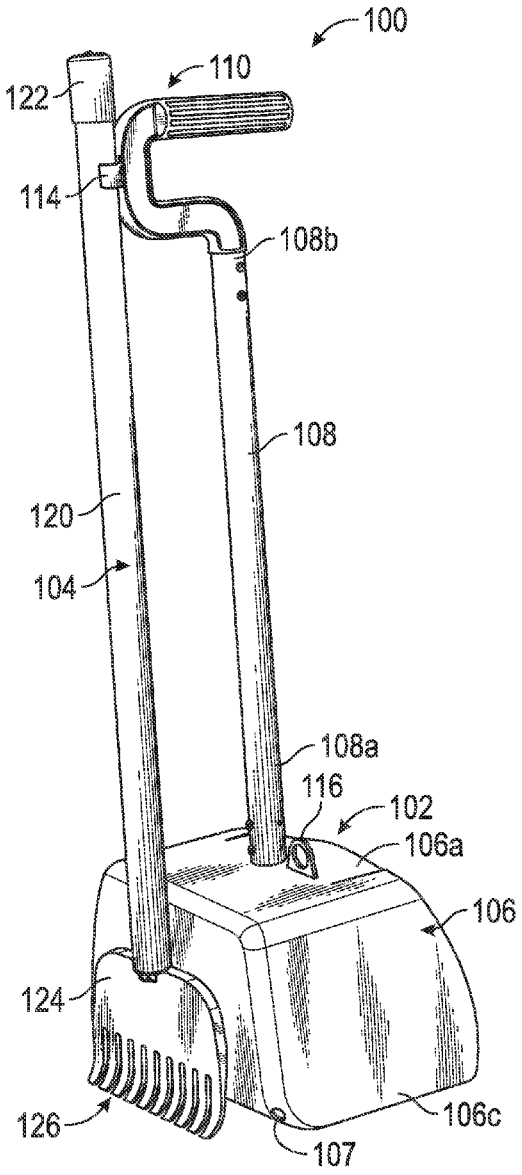
FIG. 3 illustrates a back perspective view of the waste collection device of FIG. 1.
Figure 4:
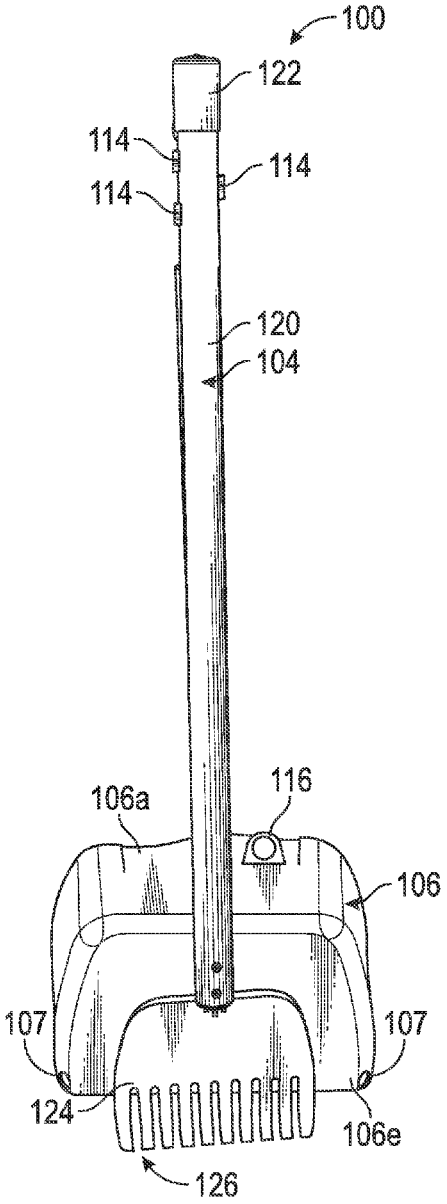
FIG. 4 illustrates a back elevation view of the waste collection device of FIG. 1.
Figure 5:
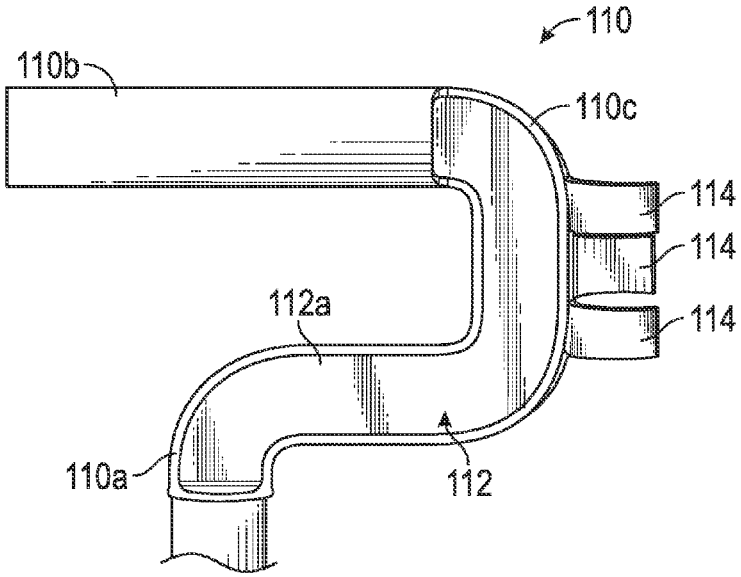
FIG. 5 illustrates a side view of a handle of the waste collection device of FIG. 1.
Figure 6:
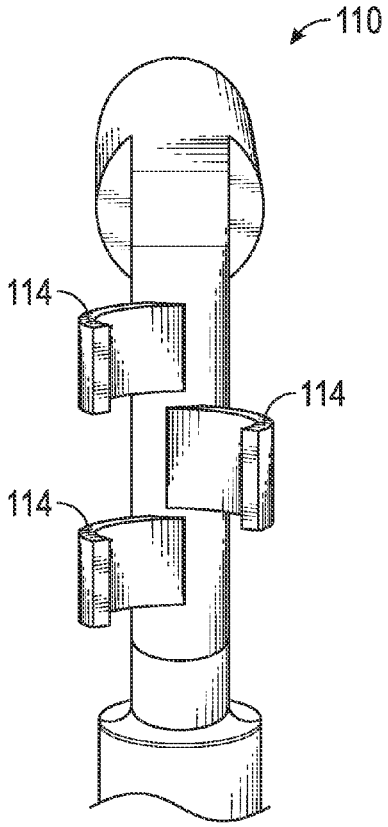
FIG. 6 illustrates a back view of a handle of the waste collection device of FIG. 1.
Figure 7:
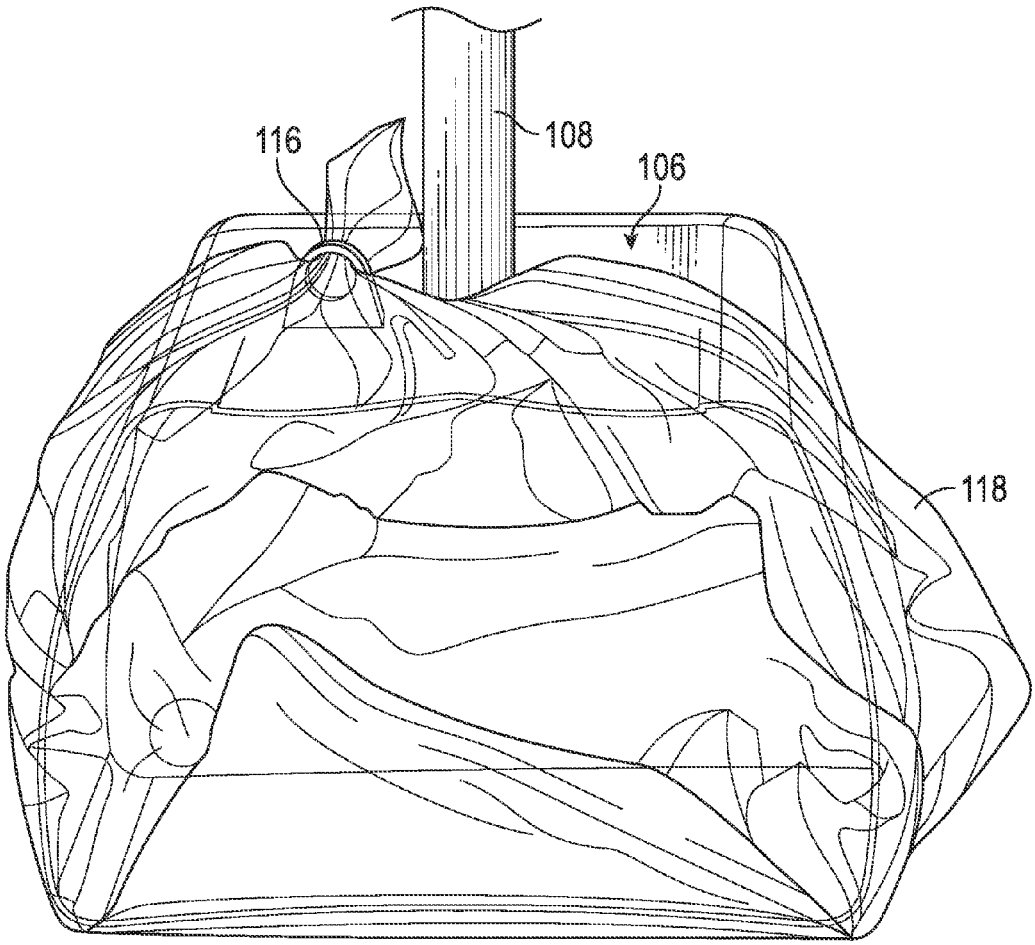
FIG. 7 illustrates a partial view of the waste collection device of FIG. 1 showing a removable bag in the receptacle.

FIG. 1 illustrates a front perspective view of a waste collection device according to one embodiment of the present invention. FIG. 2 illustrates a side elevation view of the waste collection device of FIG. 1. FIG. 3 illustrates a back perspective view of the waste collection device of FIG. 1. FIG. 4 illustrates a back elevation view of the waste collection device of FIG. 1. FIG. 5 illustrates a side view of a handle of the waste collection device of FIG. 1. FIG. 6 illustrates a back view of a handle of the waste collection device of FIG. 1. The following discussion refers interchangeably to FIGS. 1-6.

As shown, the waste collection device 100 includes a containment mechanism 102 for containing the collected waste and a scooping mechanism 104 for placing the waste in the containment mechanism 102. In one aspect, the containment mechanism 102 may include a receptacle 106 and an elongated member 108 having a first end 108*a* and a second end 108*b*, the first end of the elongated member 108 extending perpendicularly from the receptacle 106 and a handle member 110 secured to the second end 108*b* of the elongated member 108. In one aspect, the receptacle 106 may have one or more drain holes 107 located at the bottom, backside of the receptacle 106 for allowing liquid to drain. For example, if the receptacle 106 is left outside, the drain holes 107 may prevent the buildup of water within the receptacle 106.

The handle member 110 may have a lower portion 110*a* and an upper portion 110*b* integrally connected by a side portion 110*c* forming a generally U-shaped configuration. In one aspect, the lower portion 110*a* has a first length and the upper portion 110*b* has a second length, where the second length is greater than the first length.

In one aspect, a pair of opposing channels 112 may be formed in the lower portion 110*b* and side portion 110*c*. The pair of opposing channels 112 may be integrally connected by a common wall portion 112*a* such that the channels are located opposite each other. The upper portion 110*b* may be used as a grip. According to one embodiment, the pair of opposing channels 112 may be used to hold multiple types of bags, such as standard plastic bags (market/garbage), by wrapping the bags around the channels 112 until ready to be used.

The elongated member 108 may be releasably secured to the handle 110 by a plurality of retaining members 114 extending outwardly from the side portion 110*c*. As shown in FIGS. 5-6, each of the retaining members 114 may have a generally curved shape for placement around the elongated member securing the scooping mechanism 104 to the handle member 110. Each retaining member may have a first end and a second end. In one aspect, the first end of each retaining member is secured to the outer surface of the side portion 110*c* of the handle member. According to one example, the first ends of the retaining members are located in the same vertical plane on the outer surface of the side portion 110*c* of the handle member 110.

Although three retaining members 114 are shown, this is by way of example only and there may be fewer than three retaining members 114 or greater than three retaining members 114. As shown in FIG. 6, the retaining members 114 may have a generally convex configuration adapted to receive the handle member 110. The retaining members 114 enable a user to easily store and carry the scooping mechanism 104 and the containment mechanism 102.

The receptacle 106 may include a top portion 106*a*, a bottom portion 106*b* integrally connected by a first side 106*c* and a second side 106*d*, the second side 106*d* being a mirror image of the first side 106*c* and a back 106*e* integrally connected to the top portion 106*a*, the bottom portion 106*b*, the first side 106*c* and the second side 106*d*. According to one embodiment, the top portion 106*a* and the bottom portion 106*b* may have a generally square or rectangular configuration and the bottom portion 106*b* may have a smaller surface area then the top portion 106*a*. The first and second sides 106*c*, 106*d* may be curved having a convex shape. As shown in FIG. 2, the length of the top portion 106*a* (where length is defined from the opening of the receptacle 106 to the back portion 106*e* of the receptacle) may be shorter than the length of the bottom portion 106*b*. As a result of the length of the top portion 106*a* being shorter than the length of the bottom portion 106*b*, edges of the first 106*c* and second 106*d* sides may extend upwardly from the bottom portion 106*b* to the top portion 106*a* at a slight angle. This slight angle allows for the bottom portion 106*b* of the receptacle 106 to have a greater surface area to accept more waste and support a bag, as described below, than the top portion 106*a* of the receptacle 106. This also provides more space for the scooping mechanism 104 inside the receptacle 106 when scooping waste into the receptacle 106.

A bag attachment member 116, such as a ring, may extend upwardly from the top 106*a* portion of the receptacle 106. A removable bag 118 may be placed within the receptacle 106 and wrapped around the opening of the receptacle 106 and any bag excess may be pushed and/or pulled through the bag attachment member 116 until all four (4) corners of the bag are snug around the opening of the receptacle 106 maintaining the bag in place during use. According to one embodiment, the receptacle 106 may hold three (3) pounds or more of waste while still keeping the overall size of the containment mechanism 102 minimal and easy to carry around, unlike conventional systems which typically can hold only up to 1.5 pound of waste. According to one embodiment, the receptacle 106 may accommodate a variety of sizes of bags including bathroom size trashcan bags, grocery carry bags and custom designed bags.

The receptacle 106 of the containment mechanism 102 allows the user to scoop waste directly into the pre-positioned bag. After inserting the bag into the receptacle 106 prior to use, the user can scoop waste directly into the receptacle 106 lined with the pre-positioned bag. When finished, the user may tie the bag in a knot and dispose of it in the trash without getting his or her hands dirty. Lining the bag around the front of the receptacle 106 keeps it clean from waste.

As described above, FIGS. 3-4 illustrate the scooping mechanism 104 releasably secured to the handle 110. According to one embodiment, the scooping mechanism 104 may be a rake having an elongated handle 120 with an upper grip portion 122 and a lower plate portion 124 having a plurality of tines 126. According to one embodiment, the lower plate portion 124 may have a vertical length of 5.5 inches and a horizontal length of 5 inches. The horizontal length provides enough surface area to be efficient at picking up waste and fits conveniently into the receptacle 106 while scooping up waste.

According to one embodiment the entire length of the scooping mechanism 104 may be 30.5 inches which may be shorter than conventional scoopers. Furthermore, the length of the scooping mechanism 104 may be slightly taller than the containment mechanism 102. This length may align with the position the user is in when setting the scooping mechanism 104 in position to pick up waste.

According to another embodiment, the lower plate portion 124 may have ten (10) tines 126 approximately 2 inches in length, approximately 0.5-0.75 inches in width and a gap of approximately 0.25 inches between tines. The 2 inch length of the tines offers ample flexibility when in use to easily pick up waste on different surfaces and a 0.75 inch width of each tine is wide enough to make scooping easy but thin enough to minimize the amount of residual left on the scooping mechanism 104 after scooping. Furthermore, each of the tines 126 may have a straight configuration or may have a downturned finger (or bend) for use in scratching or smoothing the soil and/or engaging debris or waste. According to one embodiment, the bend may be at an approximately 45 degree angle.

The position of retaining members 114, as described above, allow for the dirty part of lower plate portion 124 and tines 126 to face away from back of the receptacle 106 reducing contact with the dirty surface.

FIGS. 5-6 illustrate plan views of the handle member 110 of the containment mechanism 102. As described above, the handle member 110 may include lower 110*a* and upper 110*b* portions integrally connected by side portion 110*c* forming a generally U-shaped configuration. The upper portion 110*b* of the handle member 110 may extend horizontally outward from the side portion 110*c* allowing the upper portion 110*b* to be used as a grip by the user.

The upper portion 110*b* of the handle member 110 of the present invention may provide for a natural position for the hand of a user to evenly carry the weight of the waste in the receptacle 106 of the containment mechanism 102. According to one embodiment, the handle member 110 may be positioned perpendicular to the receptacle 106 for supporting the normal hand position of a person when walking, i.e. palm in and thumb facing forward. This natural hand position may create less strain on the wrist and forearm of the user when carrying the entire waste collection device 100 or just the containment mechanism 102. Conventional scooper handles include only the stem with some type of padding for comfort.

According to one embodiment, the height of the elongated member 108 of the containment mechanism 102 may be shorter than conventional containment mechanisms. The length of the elongated member 108 may be short enough for the user to be able to carry the containment mechanism 102 with his or her arm fully extended when walking and not dragging on ground. The shorter length may also provide for user comfort, for example, less strain is placed on the wrist and forearm which becomes more important as the receptacle 106 gets heavier as it is filled with waste.

One or more of the components and functions illustrated in FIGS. 1-7 may be rearranged and/or combined into a single component or embodied in several components without departing from the invention. Additional elements or components may also be added without departing from the invention.

While certain exemplary embodiments have been described and shown in the accompanying drawings, it is to be understood that such embodiments are merely illustrative of and not restrictive on the broad invention, and that this invention is not be limited to the specific constructions and arrangements shown and described, since various other modifications may occur to those ordinarily skilled in the art.

The invention claimed is:

1. A waste collection device, comprising:

a containment mechanism for containing collected waste, the containment mechanism comprising:

a receptacle for receiving a bag for collecting the waste;

an elongated member having a first end and a second end, the first end of the elongated member integrally connected to and extending perpendicularly from the receptacle;

a handle member secured to the second end of the elongated member, the handle member having a lower portion, an upper portion and a side portion integrally connected to the lower portion and the upper portion forming a generally U-shaped configuration; and a plurality of retaining members extending outwardly from the handle member;

a scooping mechanism for placing the waste in the containment mechanism, the containment mechanism comprising:

an elongated handle having a first handle end and a second handle end;

a grip portion integrally connected to the first handle end; and a lower plate portion integrally connected to the second handle end, the lower plate portion including a plurality of tines.

2. The waste collection device of claim 1, wherein the lower portion and the upper portion are substantially perpendicular to the elongated member.

3. The waste collection device of claim 1, wherein the lower portion has a first length and the upper portion has a second length; and wherein the second length is greater than the first length.

4. The waste collection device of claim 1, wherein a pair of opposing channels are formed in the lower portion and the side portion.

5. The waste collection device of claim 1, wherein the plurality of retaining members extending perpendicularly outwardly from the side portion and are adapted to receive the elongated handle of the scooping mechanism.

6. The waste collection device of claim 1, wherein each retaining member in the plurality of retaining members has a generally convex configuration.

7. The waste collection device of claim 1, wherein each retaining member has a first end and a second; and wherein the first end is secured to an outer surface of the side portion of the handle member.

8. The waste collection device of claim 7, wherein the first end of each retaining member in the plurality of retaining members are located in the same vertical plane on the outer surface of the side portion of the handle member.

9. The waste collection device of claim 1, wherein the receptacle comprises:

a top portion;

a bottom portion, the bottom portion integrally connected to the top portion by a first side and a second side; and a back portion integrally connected to the top portion, the bottom portion, the first side and the second side.

10. The waste collection device of claim 9, wherein the bottom portion and the top portion have a generally square or rectangular configuration; and wherein the bottom portion has a first surface area and the top portion has a second surface area where the first surface area is larger than the second surface area.

11. The waste collection device of claim 9, wherein the first and second sides have a convex shape.

12. The waste collection device of claim 9, further comprising a bag attachment member extending upwardly from the top portion of the receptacle.

13. The waste collection device of claim 12, wherein the bag attachment member has a circular opening for receiving part of a removable bag placed within the receptacle securing the removable bag to the receptacle.

14. A waste collection device, comprising:

a containment mechanism for containing collected waste, the containment mechanism comprising:

a receptacle for receiving a bag for collecting the waste;

an elongated member having a first end and a second end, the first end of the elongated member integrally connected to and extending perpendicularly from the receptacle;

a handle member secured to the second end of the elongated member, the handle member comprising:

a lower portion;

an upper portion; and a side portion integrally connected to the lower portion and the upper portion forming a generally U-shaped configuration;

wherein a pair of opposing channels are formed in the lower portion and the side portion; and a plurality of retaining members extending outwardly from the handle member;

a scooping mechanism for placing the waste in the containment mechanism, the containment mechanism comprising:

an elongated handle having a first handle end and a second handle end;

a grip portion integrally connected to the first handle end; and a lower plate portion integrally connected to the second handle end, the lower plate portion including a plurality of tines.

15. The waste collection device of claim 14, wherein the handle member further comprises a plurality of retaining members extending perpendicularly outwardly from the side portion and adapted to receive the elongated handle of the scooping mechanism.

16. The waste collection device of claim 14, wherein the receptacle comprises:

a top portion;

a bottom portion, the bottom portion integrally connected to the top portion by a first side and a second side; and a back portion integrally connected to the top portion, the bottom portion, the first side and the second side.

17. The waste collection device of claim 16, wherein the bottom portion and the top portion have a generally square or rectangular configuration; and wherein the bottom portion has a first surface area and the top portion has a second surface area where the first surface area is larger than the second surface area.

18. The waste collection device of claim 16, wherein the first and second sides have a convex shape.

19. The waste collection device of claim 16, further comprising a bag attachment member extending upwardly from the top portion of the receptacle.

* * * * *